US006666421B2

(12) United States Patent
Hueser

(10) Patent No.: US 6,666,421 B2
(45) Date of Patent: Dec. 23, 2003

(54) BRACKET FOR MOUNTING IGNITER ON GAS WATER HEATER

(75) Inventor: Gary M. Hueser, St. Louis, MO (US)

(73) Assignee: Emerson Electric Co.

( * ) Notice: Subject to any disclaimer, the term of this patent is extended or adjusted under 35 U.S.C. 154(b) by 0 days.

(21) Appl. No.: 10/065,575

(22) Filed: Oct. 31, 2002

(65) Prior Publication Data

US 2003/0034425 A1 Feb. 20, 2003

(51) Int. Cl.[7] ..... F22B 5/04

(52) U.S. Cl. ..... 248/229.26; 248/231.81; 248/313; 248/316.7

(58) Field of Search ..... 248/229.26, 229.16, 248/228.7, 231.81, 316.1, 316.7, 213.3, 300, 310, 313, 314

(56) References Cited

U.S. PATENT DOCUMENTS

| | | | | |
|---|---|---|---|---|
| 748,438 A | * | 12/1903 | Trahan | 248/300 |
| 1,742,069 A | * | 12/1929 | Greenwald et al. | 248/229.15 |
| 2,665,103 A | * | 1/1954 | Flora et al. | 248/314 |
| 3,285,559 A | * | 11/1966 | Simon | 248/313 |
| 3,772,742 A | * | 11/1973 | Gigante | 248/231.81 |
| 3,952,985 A | * | 4/1976 | Davenport | 248/317 |
| 4,431,154 A | * | 2/1984 | Hamm | 248/215 |
| 5,312,029 A | * | 5/1994 | Tuber | 224/679 |
| 5,586,741 A | * | 12/1996 | Cuneo | 248/229.26 |
| 5,681,019 A | * | 10/1997 | Boyce | 248/229.11 |
| 5,867,874 A | * | 2/1999 | Simpson | 24/336 |
| 6,079,679 A | * | 6/2000 | Mitchell | 248/229.16 |
| 6,269,779 B2 | | 8/2001 | Overbey, Jr. | 122/13.01 |

* cited by examiner

*Primary Examiner*—Ramon O. Ramirez
*Assistant Examiner*—Jon Szumny
(74) *Attorney, Agent, or Firm*—Kevin Pumm

(57) ABSTRACT

A bracket for mounting a push-button piezo igniter to a gas valve on a water heater, while also providing electrical ground connection of the piezo igniter to the gas valve. In particular, the present invention provides a bracket that snugly receives the push-button piezo igniter and contacts to an external conductive end of the piezo igniter to provide grounding through a clip that engages and securely attaches to the gas valve.

4 Claims, 4 Drawing Sheets

BRACKET FOR MOUNTING IGNITER ON GAS WATER HEATER

BACKGROUND OF INVENTION

Recently, gas water heaters have incorporated electronic ignition devices and sealed burners, which prevent manual lighting of a pilot light with a match or other flame. Such water heaters may provide a manually activated device for electrically igniting the pilot, as shown in Overbey, U.S. Pat. No. 6,269,779. In particular, the device disclosed in Overbey is a push-button piezo igniter that allows a user to remotely activate or ignite the pilot flame from a location on the outside of the water heater. It has been difficult to incorporate piezo igniters and other similar devices into hot water heaters in an ideal location that users can easily operate. Attempts to incorporate these igniters have resulted in added cost associated with fastening the igniter on the water heater.

SUMMARY OF INVENTION

The present invention relates to a bracket for mounting a push-button piezo igniter to a gas valve on a water heater, while also providing electrical ground connection of the piezo igniter to the gas valve. In particular, the present invention provides a bracket that receives and supports the push-button piezo igniter and connects to an external conductive end of the piezo igniter to provide grounding. The bracket further comprises a clip for engaging and securely attaching to a gas valve, through which the bracket establishes an electrical ground connection via the clip. Finally, the bracket secures the push-button piezo igniter without requiring fasteners, and locates the piezo igniter in a recognizable, ergonomically accessible location on the water heater.

It should be understood that the detailed description and specific example are intended for purposes of illustrating only and are not intended to limit the scope of the invention.

DETAILED DESCRIPTION

Figure 1:
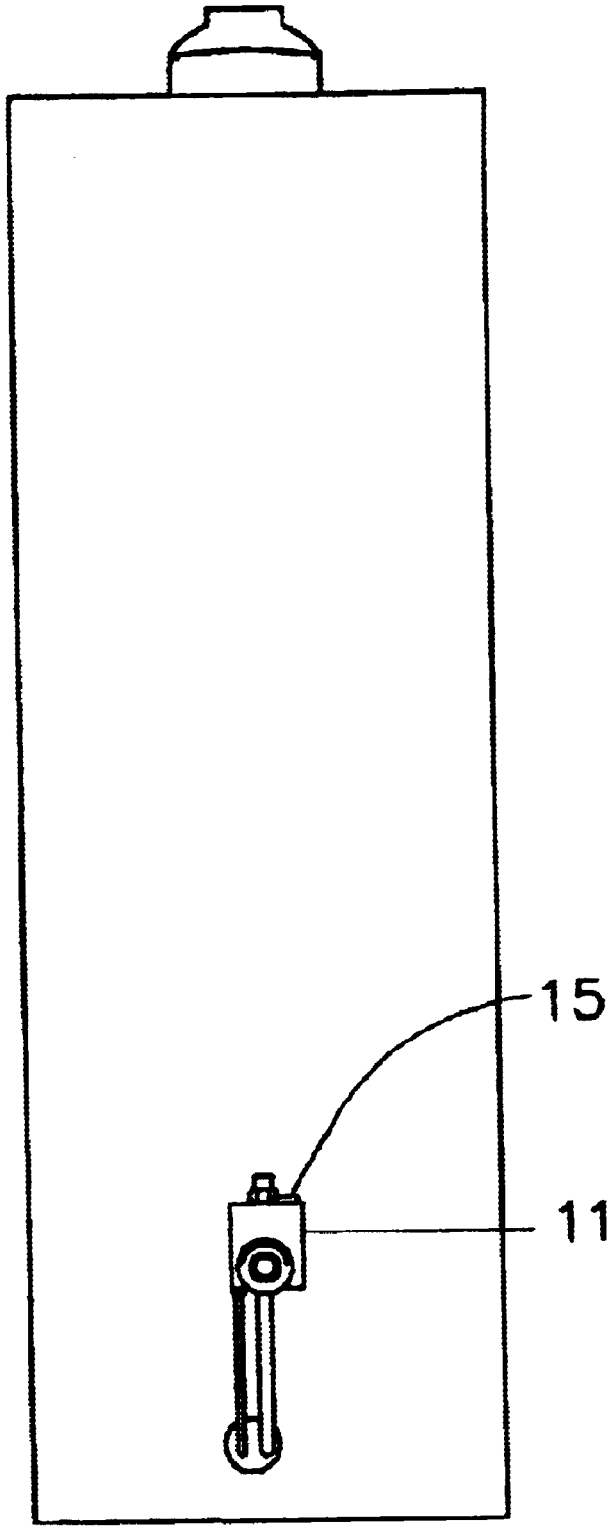
FIG. 1 is a drawing of a gas water heater and gas valve incorporating a piezo igniter in accordance with the present invention.
Figure 2:
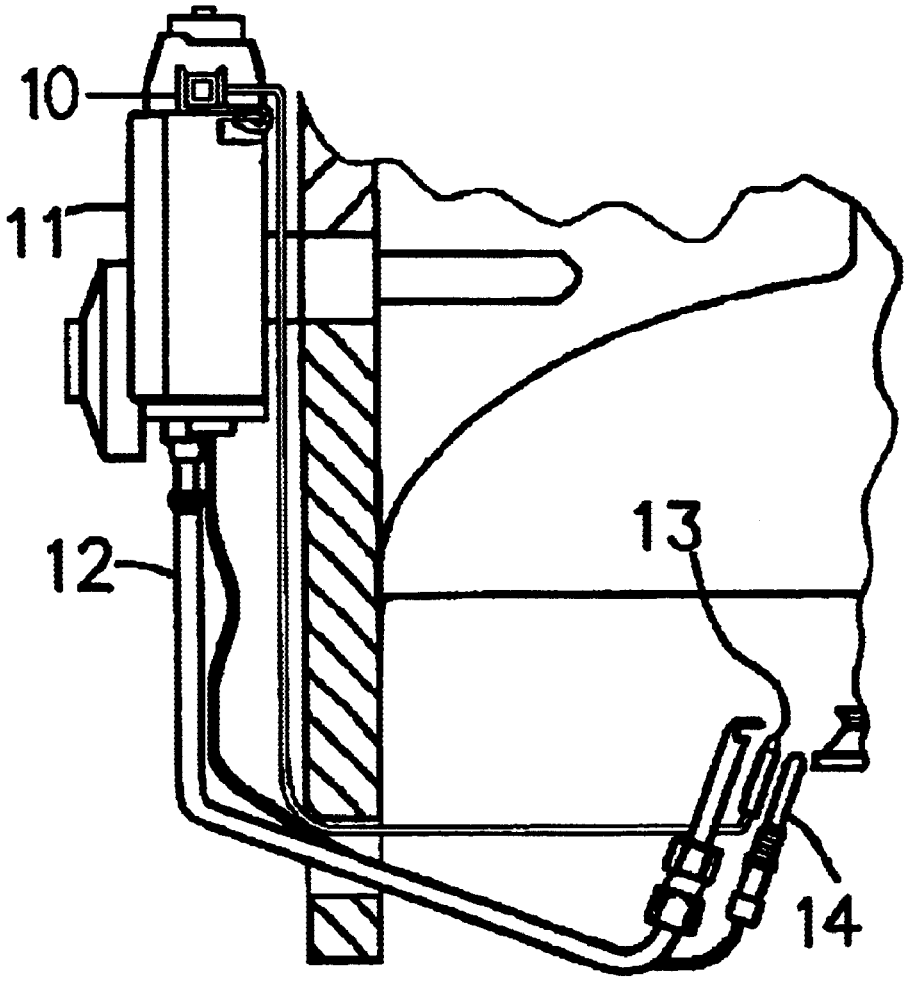
FIG. 2 is a cut away drawing of a water heater and gas valve showing a bracket mounted in accordance with the present invention.

A gas-fired water heater is generally shown in FIG. 1 with a push-button piezo igniter 15 mounted on a gas valve 11, in accordance with the present invention. FIG. 2 shows a bracket 10 of the present invention secured to the gas valve 11, which is assembled to the water heater. In operation, the gas valve 11 is manually pressed open to initiate the supply of gas through a tube 12 to provide for a pilot light. The gas at the outlet of tube 12 is ignited at electrode 13 by a spark, which is generated by the push button piezo igniter. Because such piezo igniters for generating a spark are prevalently used and well known in the art, the piezo igniter's operation will not be described in detail. By ergonomically locating the push-button piezo igniter on the gas valve 11, the user can simultaneously press the gas valve open and press the piezo igniter button with the same hand, freeing the other hand for support while visually verifying the pilot flame to be lit. The gas valve 11 will continue to supply gas to the pilot light as long as the thermocouple 14 senses flame. Once the pilot light is lit, the water heater operates normally to maintain temperature.

Figure 3:
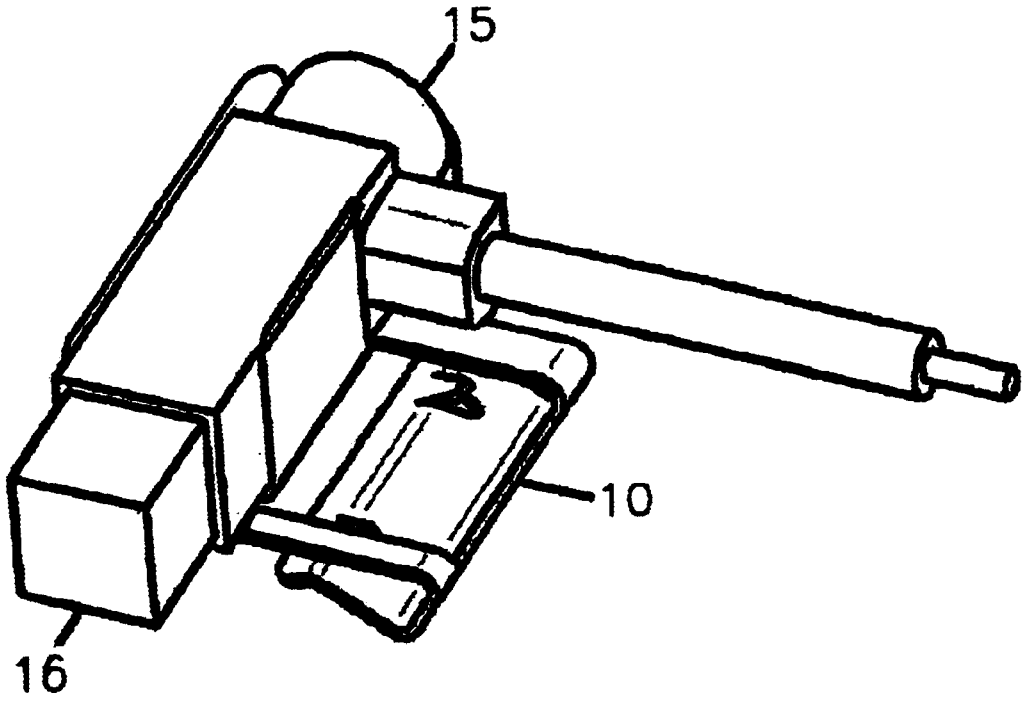
FIG. 3 is a drawing of a push-button igniter inserted into the bracket in accordance with the present invention.
Figure 4:
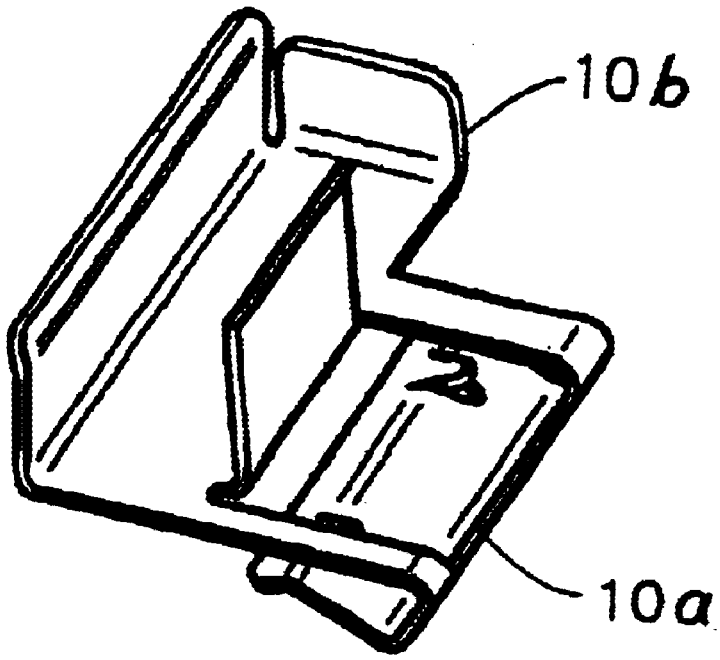
FIG. 4 is a drawing of the bracket in accordance with the present invention.

The bracket invention is shown in FIG. 3, with the push-button piezo igniter 15 inserted into the bracket 10. The bracket 10 comprises a clip that engages and securely attaches to the gas valve 11. The bracket further comprises a 3-sided enclosure for receiving the piezo igniter 15. The piezo igniter 15 is snugly held between two sides of the bracket enclosure, and a round conductive end of the piezo igniter contacts the third side **10*b* of the bracket shown in FIG. 4. This external conductor of the piezo igniter 15 electrically grounds through the bracket 10 to the gas valve 11 and the gas flow tube 12 shown in FIG. 2. Depressing the push-button 16 of the piezo igniter 15 generates a voltage potential between the grounded end of the piezo igniter 15 and an insulated wire leading from the piezo igniter 15 to the electrode 13. The voltage potential between the electrode 13 and the electrically grounded gas flow tube 12 creates a spark for igniting the pilot flame. Thus, the clip on bracket 10 also serves to establish ground connection to the valve 11, in addition to providing a means for attachment to the valve 11. More specifically, the mounting clip portion of the bracket shown in FIG. 4 is configured as a spring-loaded member 10*a*, which can expand to slide over and remain engaged to a wall on the gas valve 11. Also, the bracket's three-sided enclosure for snugly receiving the piezo igniter 15** allows for the release of an installed igniter for ease of replacement.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A bracket for mounting a piezo igniter on a gas water heater having a gas valve, the bracket comprising:

an enclosure comprising a bottom surface, and a first side, second side and third side, the first and second side being parallel and extending vertically from the bottom surface, and the third side being perpendicular to the first and second sides and extending vertically from the bottom surface, wherein the three sides and bottom surface form an enclosure adapted to releasably retaining the piezo igniter; and wherein the three sides and bottom surface also form a fourth unobstructed open side adapted to allow access to the retained piezo igniter for manually depressing a button on the igniter;

a spring clip member extending from th bottom surface and curving back to the bottom surface in such a manner as to define a planar receiving area adapted to slide on and securely retain the bracket to the gas valve;

wherein the enclosure and spring clip member are adapted to provide for an electrical ground connection for the piezo igniter to the gas valve; and wherein the bracket is adapted to locate the piezo igniter onto a planar wall portion of the gas valve.

2. The bracket according to claim 1, wherein the enclosure is biased to press against and hold the igniter in such a manner as to allow for easy removal and replacement of the piezo igniter.

3. The bracket according to claim 2, wherein the bracket is adapted to locate the igniter on the gas valve in such a manner as to allow for simultaneously depressing the piezo igniter button and a knob on the gas valve with one hand.

4. The bracket according to claim 3, wherein the bracket is constructed out of a unitary piece of electrically conductive metal.

* * * * *